US005887918A

United States Patent [19]

Okada et al.

[11] Patent Number: 5,887,918

[45] Date of Patent: Mar. 30, 1999

[54] AUTOMOBILE DOOR HANDLE

[75] Inventors: Shinji Okada; Kenji Kobashi; Yoshinori Hitomi, all of Toyota, Japan

[73] Assignee: Toyota Jidosha Kabushiki Kaisha, Toyota, Japan

[21] Appl. No.: 825,734

[22] Filed: Apr. 2, 1997

[30] Foreign Application Priority Data

May 13, 1996 [JP] Japan ..... 8-117935

[51] Int. Cl.[6] ..... E05B 63/20

[52] U.S. Cl. ..... 292/336.3; 292/141

[58] Field of Search ..... 70/336.3, 141, 70/171, 125, 135, DIG. 71, DIG. 25, DIG. 53; 292/DIG. 54, DIG. 64

[56] References Cited

U.S. PATENT DOCUMENTS

| | | | |
|---|---|---|---|
| 3,159,415 | 12/1964 | Sandor | 292/336.3 |
| 4,475,754 | 10/1984 | Arlauskas et al. | 292/336.3 |
| 4,482,179 | 11/1984 | Johnson | 292/336.3 |

FOREIGN PATENT DOCUMENTS

| | | | |
|---|---|---|---|
| 3030519 | 2/1982 | Germany | 292/336.3 |
| 63-23448 | 2/1988 | Japan . | |
| 63-125669 | 8/1988 | Japan . | |
| 63-152868 | 10/1988 | Japan . | |
| 7-331931 | 12/1995 | Japan . | |
| 1324131 | 7/1973 | United Kingdom | 292/336.3 |
| 2226076 | 6/1990 | United Kingdom | 292/336.3 |

*Primary Examiner*—Damell M. Boucher
*Attorney, Agent, or Firm*—Pillsbury Madison & Sutro LLP

[57] ABSTRACT

There is provided an automobile door handle comprising: a handle grip including a rotating shaft portion formed at one end of the handle grip, and a handle sliding portion formed at another end of the handle grip and having an engaged portion; a handle case including a rotating shaft mounting portion in which the rotating shaft portion is rotatably mounted, and a slide hole in which the handle sliding portion is inserted; and a lever including a wire connecting portion to which a wire connected to a door lock releasing mechanism is connected, and an engaging portion engaged with the engaged portion, the lever being rotatably supported by the handle case, in which a reinforcing portion is provided within the slide hole and a recessed portion is provided in the handle sliding portion to prevent the handle sliding portion and the reinforcing portion from interfering with each other.

18 Claims, 5 Drawing Sheets

AUTOMOBILE DOOR HANDLE

BACKGROUND OF THE INVENTION

1. Field of the Invention

The present invention relates to an automobile door handle, and particularly to an automobile door handle having a handle grip and a handle case.

2. Description of the Related Art

Conventionally, as an automobile door handle having a handle grip and a handle case, the structure disclosed in Japanese Utility Model Application Laid-Open (JP-U) No. 63-125669 has been known.

Japanese Utility Model Application Laid-Open (JP-U) No. 63-23448 discloses a grip-type handle in which a handle and a door lock releasing mechanism are connected by a rod. Japanese Utility Model Application Laid-Open (JP-U) No. 63-152868 discloses a grip-type handle having a lever which is rotatably supported by a base. Further, Japanese Patent Application Laid-Open (JP-A) No. 7-331931 discloses a grip-type handle in which an engaging hole, with which a lever is engaged, is formed in a sliding portion of the handle.

The structure disclosed in Japanese Utility Model Application Laid-Open (JP-U) No. 63-125669 will be described hereinafter.

As shown in FIG. 5, in an automobile door handle 70, one end portion 74A of a handle grip 74 is connected to one end portion 72A of a handle case 72 fixed to a side door 71 and the handle grip 74 is provided to be swingable, with respect to the handle case 72, around a portion at which the end portion 74A is connected to the end portion 72A in upward and downward directions on the paper of FIG. 5 (i.e., the directions indicated by double-headed arrow S). A lever 80 is rotatably supported by a pin 78 on a protruding arm 76 provided at another end 72B of the handle case 72. The lever 80 is engaged with a concave portion 84 which is formed at a vicinity of a tip end portion of a circular arc-shaped projecting member 82 provided in another end portion 74B of the handle grip 74. The circular arc-shaped projecting member 82 is provided to pass through a through hole 86 formed in the handle case 72. Accordingly, when the handle grip 74 swings and moves from the position indicated by the solid line in FIG. 5 to that indicated by the two-dot chain line, the lever 80 engaged with the concave portion 84 of the circular arc-shaped projecting member 82 rotates so that locking of the side door 71 is released.

However, in this automobile door handle 70, when the handle grip 74 swings and moves to the position indicated by the two-dot chain line in FIG. 5, the lever 80 abuts against an outer peripheral edge of the through hole 86 of the handle case 72 to prevent the handle grip 74 to slip out of the through hole 86. For this reason, a great load is applied to the outer peripheral edge of the through hole 86. Accordingly, it is considered that the outer peripheral edge of the through hole 86 is reinforced by increasing the thickness M thereof. However, in this case, since the door handle 70 becomes larger, this method is not preferable.

SUMMARY OF THE INVENTION

In view of the above-described circumstances, it is an object of the present invention to provide an automobile door handle in which the supporting strength of a lever can be improved without a handle case being made larger.

A first aspect of the present invention is an automobile door handle which comprises: a handle grip including a rotating shaft portion formed at one end of the handle grip, and a handle sliding portion formed at another end of the handle grip and having an engaged portion; a handle case including a rotating shaft mounting portion in which the rotating shaft portion is rotatably mounted, and a slide hole in which the handle sliding portion is inserted; and a lever including a wire connecting portion to which a wire connected to a door lock releasing mechanism is connected, and an engaging portion engaged with the engaged portion, the lever being rotatably supported by the handle case, wherein a reinforcing portion is provided within the slide hole and a recessed portion is provided in the handle sliding portion to prevent the handle sliding portion and the reinforcing portion from interfering with each other.

Accordingly, when the handle grip swings around the rotating shaft portion with respect to the handle case, the handle sliding portion of the handle grip slides within the slide hole formed in the handle case. At this time, the handle sliding portion and the reinforcing portion do not interfere with each other by the recessed portion.

Further, when the handle sliding portion slides within the slide hole, the lever engaged with the engaged portion of the handle sliding portion rotates to move the wire connected to the wire connecting portion of the lever and to the door lock releasing mechanism, and the door lock is thereby released. As a result, the supporting strength of the lever can be improved without the handle case being made larger.

A second aspect of the present invention is an automobile door handle, and in the first aspect of the present invention the reinforcing portion is provided so as to abut against the lever.

Accordingly, load applied to the lever by the handle grip when a full stroke of a handle is made (i.e., when door lock is released) is effectively absorbed by contact surfaces of the lever and the reinforcing portion. Further, it is not necessary to reinforce the lever and the handle case supporting portion of the lever to high strength.

DESCRIPTION OF THE PREFERRED EMBODIMENTS

Figure 1:
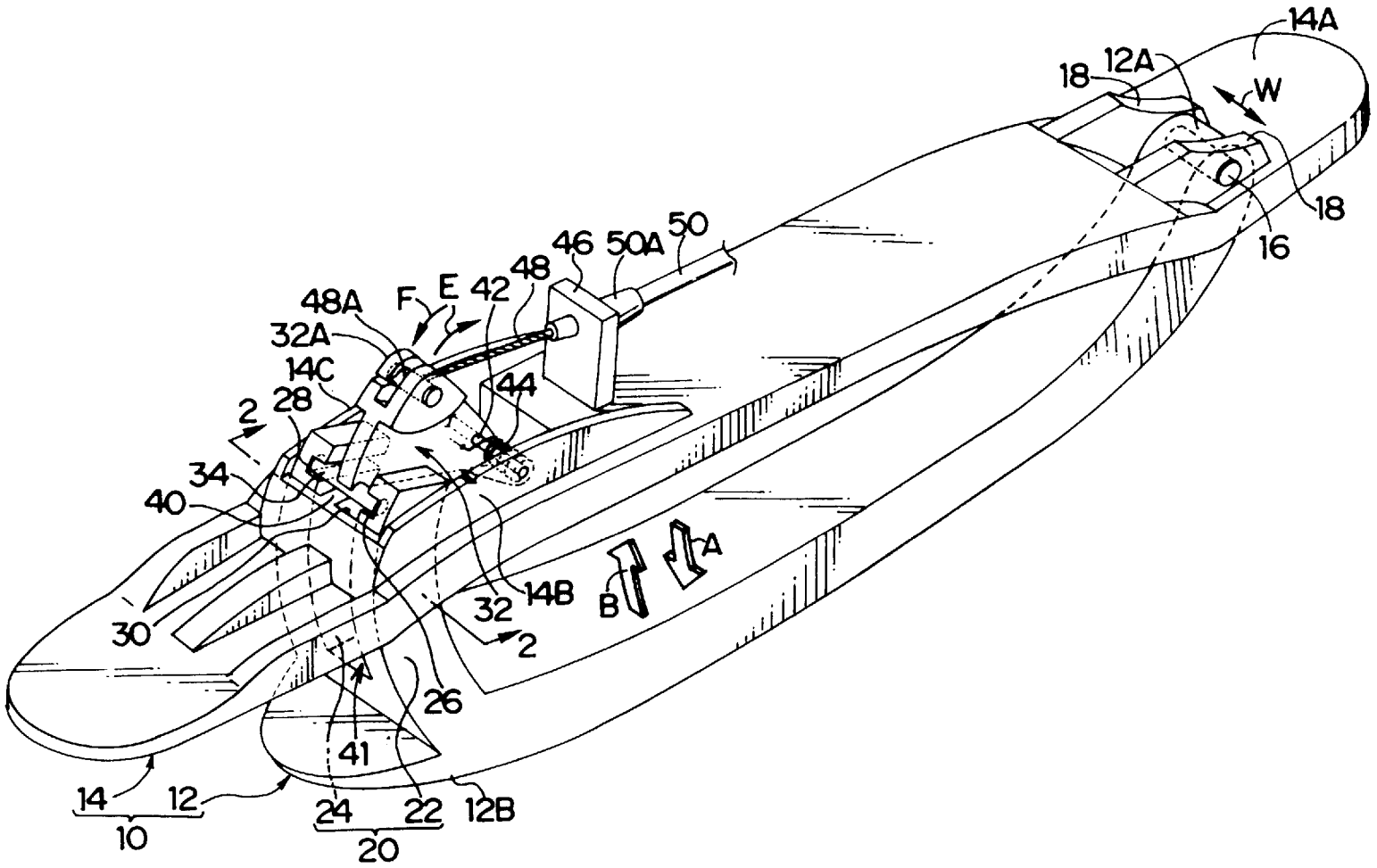
FIG. 1 is a perspective view showing an automobile door handle according to an embodiment of the present invention.
Figure 2:
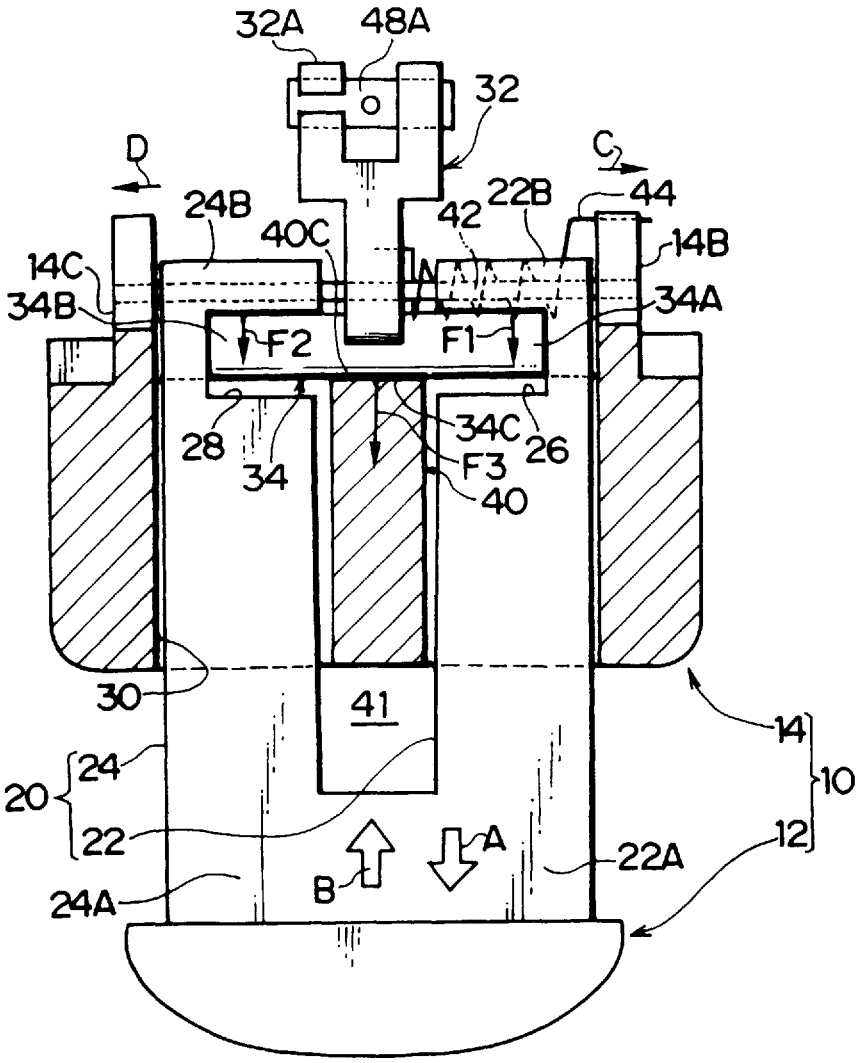
FIG. 2 is a cross-sectional view taken along the lines 2—2 in FIG. 1.

Referring now to FIGS. 1 and 2, a description will be given of an embodiment of an automobile door handle of the present invention.

As shown in FIG. 1, an automobile door handle 10 of the present invention includes a handle grip 12 and a handle case 14. Formed in one end portion 12A of the handle grip 12 are rotating shaft portions 16 which are respectively provided to project in opposite directions transversely from the handle grip 12 (i.e., the directions indicated by double-head arrow W in FIG. 1). These rotating shaft portions 16 are respectively supported rotatably by a pair of rotating shaft mounting portions 18 formed at positions near one end portion 14A of the handle case 14.

Accordingly, the handle grip 12 is provided to be swingable around the rotating shaft portions 16 with respect to the handle case 14 in directions in which the handle grip 12 moves away from and close to the handle case 14 (i.e., the directions indicated by arrow A and arrow B in FIG. 1).

A handle sliding portion 20 is formed in another end portion 12B of the handle grip 12 so as to face the handle case 14. The handle sliding portion 20 is formed from a pair of facing columnar bodies 22, 24. These columnar bodies 22, 24 are formed to be bent along a locus of rotation of the handle grip 12.

As shown in FIG. 2, respective base portions 22A, 24A of the columnar bodies 22, 24 are connected to each other. Engaged portions 26, 28 are respectively formed in end portions 22B, 24B of the columnar bodies 22, 24 at positions where the end portions 22B, 24B face each other. Further, the handle sliding portion 20 is inserted in a slide hole 30 formed in the handle case 14 in such a manner as to be slidable within the slide hole 30. Meanwhile, the end portions 22B, 24B of the columnar bodies 22, 24 of the handle sliding portion 20 are respectively provided to project toward a back side of the handle case 14 (i.e., toward an upper side on the paper of FIG. 2).

Case ribs 14B, 14C are provided on the back side of the handle case 14 along the direction to which the columnar bodies 22, 24 project, and inclinations of the columnar bodies 22, 24 in transversely outward directions of the handle case 14 (i.e., the directions indicated by arrow C and arrow D in FIG. 2) is thereby prevented. Further, end portions 34A, 34B of an engaging shaft portion 34 which is formed, as an engaging portion, at an end portion of a lever 32 are respectively engaged with the engaged portions 26, 28 of the handle sliding portion 20.

A case stopper rib 40 serving as a reinforcing portion is integrally formed at the central portion of the sliding hole 30 formed in the handle case 14. The case stopper rib 40 is disposed within a recessed portion 41 formed between the columnar bodies 22, 24 and an intermediate portion 34C of the engaging shaft portion 34 of the lever 32 abuts against an end surface 40C of the case stopper rib 40.

As shown in FIG. 1, the lever 32 is supported to be rotatable around a rotating shaft 42 and both end portions of the rotating shaft 42 are supported by the case ribs 14B, 14C, respectively. For this reason, the lever 32 is provided to be rotatable around the rotating shaft 42 in directions where the lever 32 moves away from and close to the case stopper rib 40 (i.e., the directions indicated by arrow E and arrow F in FIG. 1). Further, a coil spring 44 is wound around the rotating shaft 42 and one end portion of the coil spring 44 is engaged with the case rib 14B. Another end portion of the coil spring 44 is fixed to the lever 32 and the coil spring 44 causes the lever 32 to be urged in a direction where the engaging shaft portion 34 moves away from the case stopper rib 40 (i.e., the direction indicated by arrow E in FIG. 1).

A wire supporting portion 46 is provided vertically on the back surface of the handle case 14 and an end portion 50A of a tube 50 of a wire 48 connected to a door lock releasing mechanism is fixed to the wire supporting portion 46. Further, one end portion of the wire is fixed to an anchor 48A and the anchor 48A is engaged with a wire connecting portion 32A of the lever 32. Accordingly, when the lever 32 rotates in the direction indicated by arrow F in FIG. 1 against urging force of the coil spring 44, the wire 48 is pulled out from the end portion 50A of the tube 50 so that locking of the door is released.

Next, an operation of the present embodiment will be described.

In the present embodiment, when a vehicle occupant's hand is moved in the direction indicated by arrow A in FIG. 1 with the handle grip 12 being held by the occupant's hand, the handle grip 12 swings around the rotating shaft portions 16 with respect to the handle case 14 in the direction indicated by arrow A. When the handle grip 12 swings, the handle sliding portion 20 formed in the handle grip 12 slides within the slide hole 30 and the lever 32 with the engaging shaft portion 34 is engaged with the engaged portions 26, 28 of the handle sliding portion 20 rotates in the direction indicated by arrow F against the urging force of the coil spring 44. When the lever 32 rotates in the direction indicated by arrow F, the wire 48 is pulled out from the end portion 50A of the tube 50 and locking of the door is thereby released.

At this time, in the automobile door handle 10 of the present embodiment, the intermediate portion 34C of the engaging shaft portion 34 of the lever 32 abuts against the case stopper rib 40.

As described above, since the present embodiment is constructed in that the handle sliding portion 20 is formed by the pair of facing columnar bodies 22, 24 and the case stopper rib 40 is formed between these columnar bodies 22, 24 within the slide hole 30 of the handle case 14, a region of the handle case 14 in which the slide hole 30 is formed can be reinforced without the thickness of the peripheral portion of the slide hole 30 being made larger. For this reason, there is no possibility that the handle case 14 be made larger.

Further, as shown in FIG. 2, in the present embodiment, in the state in which the intermediate portion 34C of the engaging shaft portion 34 of the lever 32 abuts against the case stopper rib 40, handle grip operating loads F1, F2 respectively applied to the end portions 34A, 34B of the engaging shaft portion 34 via the engaged portions 26, 28 of the handle sliding portion 20 can be received by the end surface 40C of the case stopper rib 40 which abuts against the intermediate portion 34C of the engaging shaft portion 34.

Accordingly, the handle grip operating loads F1, F2 form load F3 (F3=F1+F2) to be efficiently transmitted to the case stopper rib 40 via the engaging shaft portion 34. For this reason, since the handle grip operating loads F1, F2 are not directly applied to other regions of the lever 32, it is unnecessary to reinforce the entire lever 32. Further, since the lever 32 is formed of a resin member, reduction in cost therefor can be achieved.

In addition, in the present embodiment, the central portion of the slide hole 30 of the handle case 14 is reinforced by the case stopper rib 40 so that the slide hole 30 can be effectively reinforced.

Figure 3:
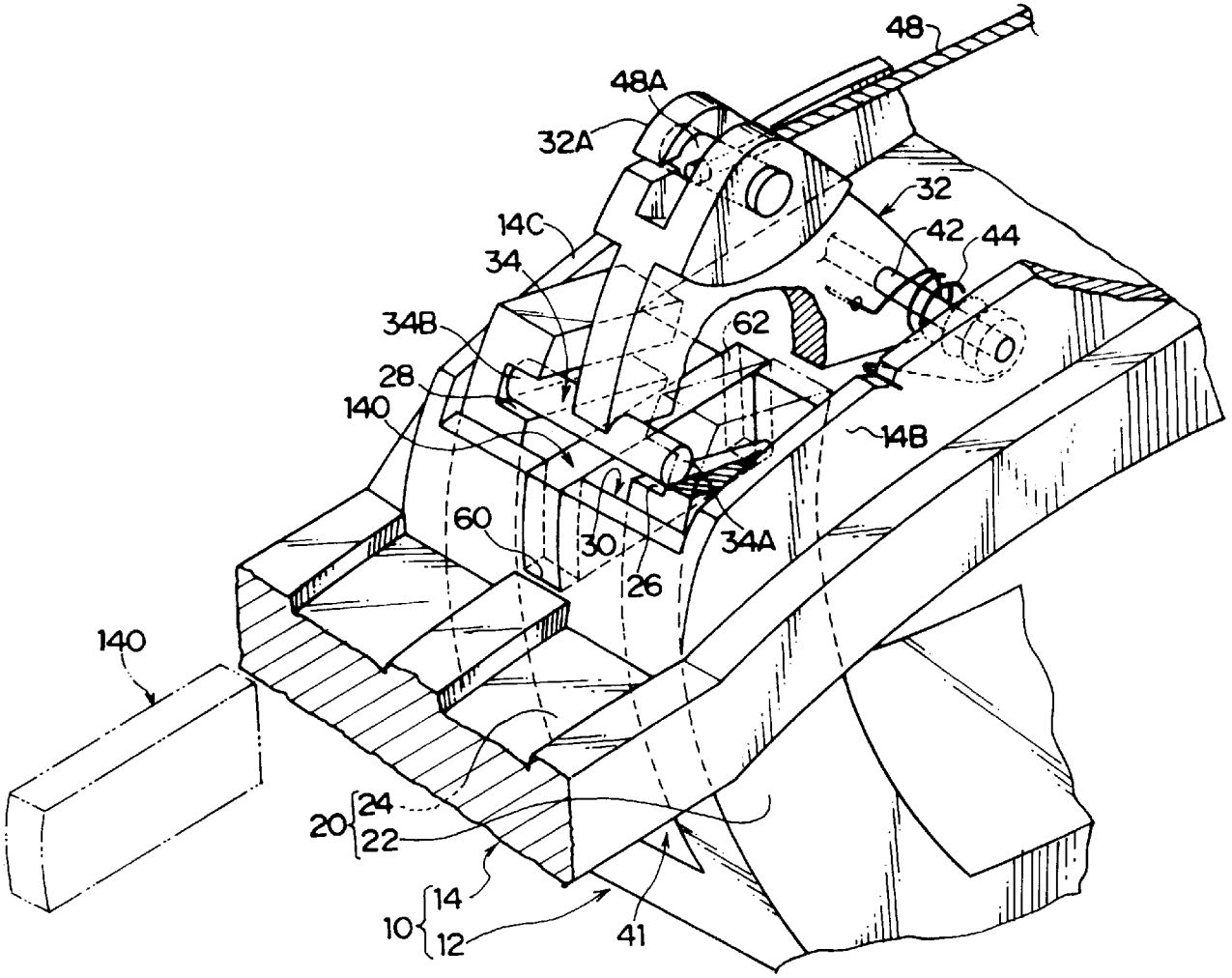
FIG. 3 is an enlarged perspective view, partly in cross section, of an automobile door handle according to another embodiment of the present invention.

In the foregoing, although the present invention was described in detail with reference to the specified embodiment, it is not limited to the same, and it will become clear to those skilled in the art that other various modifications may be made within the scope of the invention as hereinafter claimed. For example, in the present embodiment, the case stopper rib 40 is integrally formed within the slide hole 30 formed in the handle case 14. However, as shown in FIG. 3, in place of this structure, a case stopper rib 140 formed separately from the handle case 14 may be mounted between notches 60, 62 formed in an external wall portion of the slide hole 30.

Further, in the present embodiment, the case stopper rib 40 is provided at the central portion of the slide hole 30, but the position of the case stopper rib 40 is not limited to the central portion of the slide hole 30. Moreover, in the present embodiment, the recessed portion 41 is formed between the columnar bodies 22, 24 of the handle sliding portion 20, but the position of the recessed portion 41 is not limited to that between the columnar bodies 22, 24. It suffices that the recessed portion 41 be disposed at any position where the recessed portion 41 does not interfere with the case stopper rib 40.

Figure 4A:
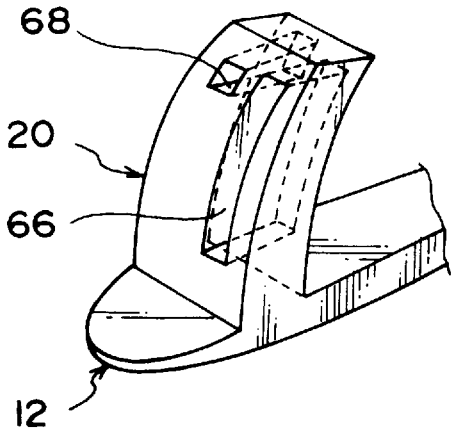
FIG. 4A is a perspective view showing a handle grip of an automobile door handle according to yet another embodiment of the present invention.
Figure 4B:
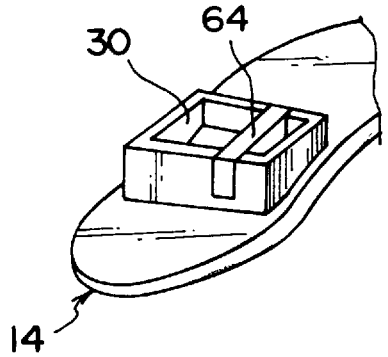
FIG. 4B is a perspective view showing a handle case of the automobile door handle according to the yet another embodiment of the present invention.
Figure 4C:
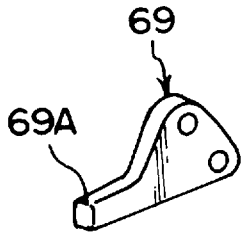
FIG. 4C is a perspective view showing a lever of the automobile door handle according to the yet another embodiment of the present invention.
Figure 5:
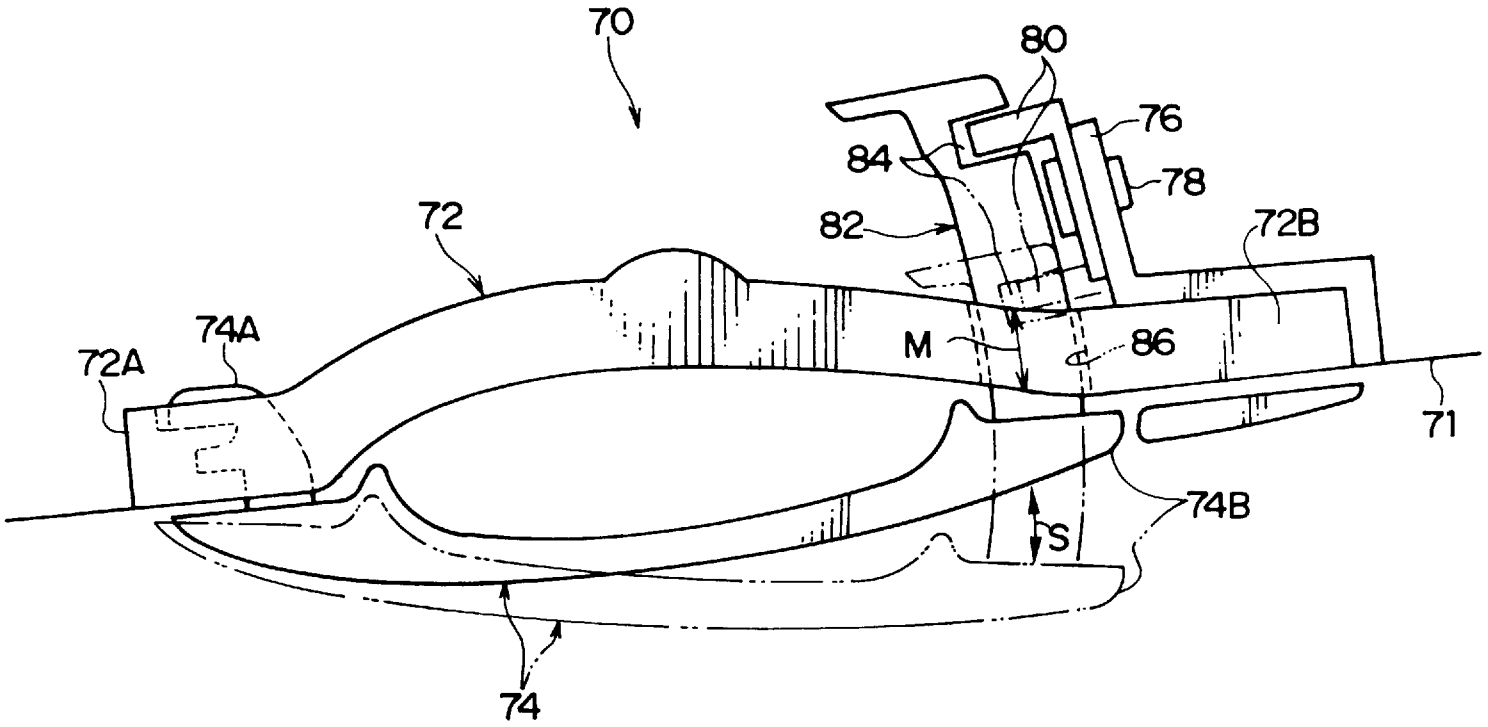
FIG. 5 PRIOR ART
FIG. 5 is a side view showing a conventional automobile door handle.

In addition, the structure provided by the present embodiment is such that the lever 32 abuts against the case stopper rib 40 which serves as the reinforcing portion. However, there may be applied a structure in that, as shown in FIG. 4A, a recessed portion 66 provided to correspond to a reinforcing portion 64 shown in FIG. 4B is formed in the handle sliding portion 20 in such a manner that the reinforcing portion abuts against an end portion of the recessed portion 66 when the handle grip 12 swings to move away from the handle case 14, and an end portion 69A of a lever 69 shown in FIG. 4C is engaged with an engaged portion 68 formed in the handle sliding portion 20 at a position separated from the recessed portion 66 by a predetermined distance.

What is claimed is:

1. An automobile door handle comprising:

a handle grip including a rotating shaft portion formed at one end of the handle grip, and a handle sliding portion formed at another end of the handle grip and having an engaged portion;

a handle case including a rotating shaft mounting portion in which the rotating shaft portion is rotatably mounted, and a slide hole in which the handle sliding portion is inserted; and a lever including a wire connecting portion to which a wire adapted to be connected to a door lock releasing mechanism of an automobile door is connected, and an engaging portion engaged with the engaged portion, said lever being rotatably supported by said handle case, wherein a reinforcing portion is provided within the slide hole, said reinforcing portion spanning the interior of the slide hole, and a recessed portion is provided in the handle sliding portion to prevent the handle sliding portion and the reinforcing portion from interfering with each other.

2. An automobile door handle according to claim 1, wherein the reinforcing portion abuts against said lever.

3. An automobile handle according to claim 2, wherein the recessed portion and the engaged portion communicate with each other.

4. An automobile door handle according to claim 1, wherein the reinforcing portion abuts against the recessed portion when said handle grip swings.

5. An automobile door handle according to claim 4, wherein the recessed portion and the engaged portion are separated from each other by a predetermined distance.

6. An automobile door handle according to claim 1, wherein the reinforcing portion is integrally formed with said handle case.

7. An automobile door handle according to claim 1, wherein the reinforcing portion is formed separately from said handle case.

8. An automobile door handle according to claim 1, further comprising:

urging means for urging said lever so that an engaging portion of said lever moves away from the reinforcing portion.

9. An automobile door handle comprising:

a handle grip including a rotating shaft portion formed at one end of the handle grip, and a handle sliding portion formed at another end of the handle grip and having an engaged portion;

a handle case including a rotating shaft mounting portion in which the rotating shaft portion is rotatably mounted, and a slide hole in which the handle sliding portion is inserted; and a lever including a wire connecting portion to which a wire adapted to be connected to a door lock releasing mechanism of an automobile door is connected, and an engaging portion engaged with the engaged portion, said lever being rotatably supported by said handle case, wherein a reinforcing portion is provided within the slide hole and a recessed portion is provided in the handle sliding portion to prevent the handle sliding portion and the reinforcing portion from interfering with each other, wherein the reinforcing portion spans the interior of the sliding hole, and the reinforcing portion is formed integrally with the handle case.

10. An automobile door handle according to claim 9, wherein the reinforcing portion abuts against said lever.

11. An automobile handle according to claim 2, wherein the recessed portion and the engaged portion communicate with each other.

12. An automobile door handle according to claim 9, further comprising:

urging means for urging said lever so that an engaging portion of said lever moves away from the reinforcing portion.

13. An automobile door handle comprising:

a handle grip including a rotating shaft portion formed at one end of the handle grip, and a handle sliding portion formed at another end of the handle grip and having an engaged portion;

a handle case including a rotating shaft mounting portion in which the rotating shaft portion is rotatably mounted, and a slide hole in which the handle sliding portion is inserted; and a lever including a wire connecting portion to which a wire adapted to be connected to a door lock releasing mechanism of an automobile door is connected, and an engaging shaft portion engaged with the engaged portion, said lever being rotatably supported by said handle case, wherein a reinforcing portion which abuts an intermediate portion of the engaging shaft portion is provided within the slide hole and a recessed portion is provided in the handle sliding portion to prevent the handle sliding portion and the reinforcing portion from interfering with each other.

14. An automobile door handle according to claim 13, wherein the intermediate portion of the engaging shaft portion is connected to the wire connecting portion, and both end portions of the engaging shaft portion engage with the engaged portion.

15. An automobile door handle according to claim 13, wherein the reinforcing portion abuts against said lever.

16. An automobile handle according to claim 13, wherein the recessed portion and the engaged portion communicate with each other.

17. An automobile door handle according to claim 13, wherein the reinforcing portion is integrally formed with said handle case.

18. An automobile door handle according to claim 13, wherein the reinforcing portion is formed separately from said handle case.

* * * * *